United States Patent [19]

Kifferstein et al.

[11] 4,183,524

[45] Jan. 15, 1980

[54] PRACTICE NET

[76] Inventors: Warren M. Kifferstein, 1510 W. Webster, Royal Oak, Mich. 48073; Harry P. Kifferstein, 27250 Harvard Rd., Southfield, Mich. 48075

[21] Appl. No.: 728,744

[22] Filed: Oct. 1, 1976

[51] Int. Cl.[2] ..... A63B 69/38

[52] U.S. Cl. ..... 273/29 A; 273/181 F

[58] Field of Search ..... 273/29 B, 29 A, 181 F, 273/181 K, 181 R, 1.5 R, 1 R; 49/50, 52, 53, 56, 54, 104, 146, 197, 198, 61, 62; 160/89, 90, 91, 207, 209, 166, 113, 20, 201, 381

[56] References Cited

U.S. PATENT DOCUMENTS

| | | | |
|---|---|---|---|
| 2,517,461 | 8/1950 | Cobb | 273/1.5 R |
| 3,502,330 | 3/1970 | Chaftel | 273/1 R |

*Primary Examiner*—Richard C. Pinkham
*Assistant Examiner*—T. Brown
*Attorney, Agent, or Firm*—Hauke and Patalidis

[57] ABSTRACT

A practice net for tennis that can be attached to a garage door and stored in a plane co-planar with the plane of the garage door in a first condition of operation and be operable in a position substantially perpendicular to the garage door in a second condition of operation for rebounding tennis balls.

6 Claims, 15 Drawing Figures

PRACTICE NET

This invention relates generally to practice nets. More particularly, this invention relates to practice nets associated with garage doors in such a manner that the practice net can be stored in a substantially flush condition with the garage door in one condition of operation, and be operable to rebound tennis balls in a position adjacent to the non-coplanar with the garage door in a second condition of operation.

In the past, numerous devices have been devised for use as practice nets in tennis and in other sports involving a missile. The devises have been of the free-standing type as well as attached to poles and other equipment. Also, other sporting devices such as basketball boards or rebound boards have been deviced that are either free standing or directly attached to building structures.

One problem with the free-standing type of devices above-mentioned is that they lack rigidity to withstand normal playing use or, where such rigidity exists, the associated structure for maintaining that rigidity is heavy, cumbersome, and relatively expensive to manufacture, use and maintain.

One of the problems associated with such sporting devices that are directly attached to building structures is that they are relatively cumbersome and expensive to install and are exposed to the elements of weather for long periods when not in use.

A difficulty associated with both free standing and building structure attached devices is the inability to readily store in a confined area removed from exposure to weather elements and removed from the danger of being damaged by the collision with such devices by extraneous devices such as automobiles, bicycles, or children.

Still another difficulty with both the free standing and the building structure attached sporting devices is the relative inaccessibility for the free-standing types from appropriate playing field areas and relative confinement of the building attached structures to specific areas that on some occasions may be appropriate for playing field use and on other occasions are not appropriate areas for such use.

For example, an attached building structure device such as a basketball rebound board may be in an appropriate area for practicing basketball when no cars are in the driveway. However, when cars are in the driveway, it is obviously not in an appropriate area for practice.

Accordingly, it is an object of this invention to provide a structure for the practicing of sporting activities that can be stored within a convenient relatively confined space in one condition of operation and can be operated for the practicing of sporting ventures in another condition of operation and that is relatively inexpensive and uncomplicated to make, use, market and maintain.

It is another object of this invention to provide a structure for use in the practicing of sporting activities that can be stored and utilized in a location that provides alternative spaces in conjunction with the use thereof.

It is a still further object of this invention to provide a tennis practice net attached to a garage door that can be selectively stored in a position substantially flush with the garage door when the garage door is either closed or open, and can be selectively moved with respect to the garage door when the garage door is open to attain a position of operation whereby it may be utilized for the practice of tennis either from the driveway in front of the garage or from within the garage itself.

It is another object of this invention to provide a structure for use in tennis practice that can be attached to a garage door and that will have a slight swing due to the momentum of the ball against the structure thereby serving to provide different rebound positions to enrich the practice, and yet not be susceptible to being knocked down by wind or similar force, as a free-standing net structure would be.

These and other objects of this invention are achieved by the provision of a frame structure, a rebound surface structure associated with the frame structure, attaching the frame structure to an enclosure door, means limiting movement of the frame structure with respect to the enclosure door, and an additional member de-actuating the limiting means from operation selectively.

It is a still further object of this invention to provide a means for selectively enclosing a garage or similar structure by means other than the garage door by having such additional means attached to the garage door and an additional member for selectively allowing motion of the additional structure with respect to the garage door such that after such motion the additional structure will close off the garage area by a net or other suitable means.

These and other objects of this invention can be appreciated from the following specifications and claims.

ON THE DRAWINGS

Before explaining the present invention in detail, it is to be understood that the invention is not limited in its application to the details in construction and arrangement of parts illustrated in the accompanying drawings since the invention is capable of other embodiments and of being practiced or carried out in various ways.

Also, it is to be understood that the phraseology and terminology employed herein are for the purpose of description and not of limitation.

AS SHOWN ON THE DRAWINGS

Figure 1:
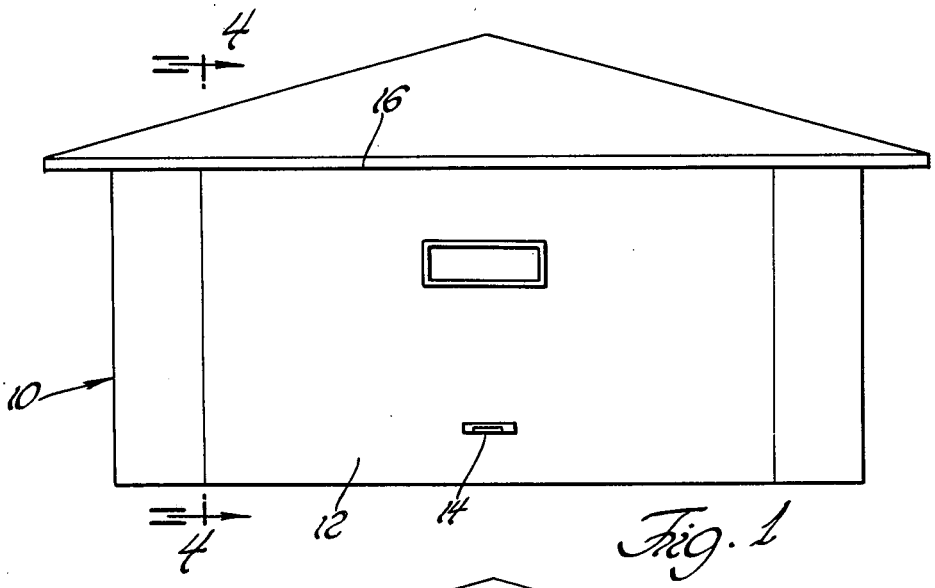
FIG. 1 is a front view of a garage utilizing the preferred embodiment of this invention when the garage door is in a closed condition.

FIG. 1 discloses a garage 10 having a garage door 12 showing a handle 14 for the lifting and raising thereof. The garage door 12 is enclosed within a large frontal aperture 16 within the forward face of the garage 10. The garage 10 is shown with the garage door 12 in a down or closed position.

Figure 2:
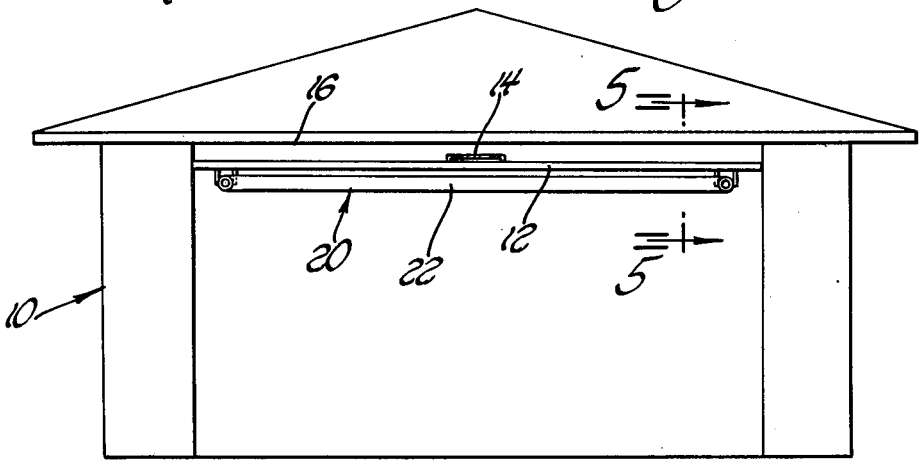
FIG. 2 is a front view of the apparatus shown in FIG. 1 when the garage door is in an open condition.

FIG. 2 shows the apparatus shown in FIG. 1 with the garage door 12 in an upper or raised condition.

A practice net structure 20 has a frame 22 on the periphery thereof including the top side and bottom edge portions thereof. The frame 22 is preferably made of an aluminum tubing such as SAE 2020 aluminum alloy in standard tubular stock.

Figure 3:
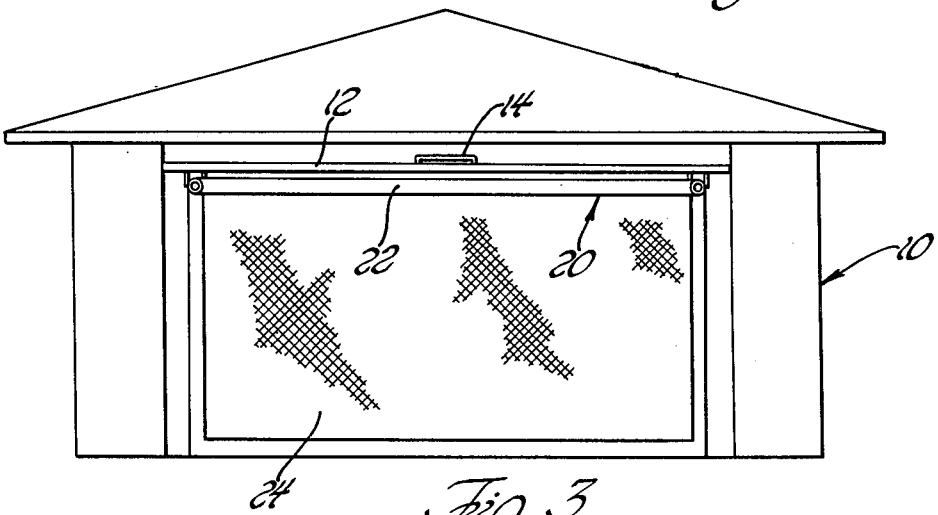
FIG. 3 is a front view of the apparatus shown in FIG. 2 when the net structure is in a lowered position.

As can be observed in FIG. 3, a net or webbing 24 is strung across the frame 22 of the net structure 20. The net 24 is preferably nylon netting made of multiple strand cords and having a fish-net like appearance with apertures having an order of magnitude of approximately ½" corresponding to a mere fraction of the diameter of a regulation tennis ball.

The net or webbing 24 can be secured to the frame 22 by means of fabric strands attached to the perimeter of the net and tied around the associated frame 22. Alternatively, the net 24 may be attached to the frame 22 by tying fabric strands that are fixedly attached to the net 24 at one end thereof and attached at the other end thereof to a metal pin which has one end thereof externally threaded to threadably engage an internally threaded aperture in the frame 22. In the immediately aforementioned alternative method of attaching the net 24 to the frame 22, tension in the net 24 may be selectively increased or decreased by selectively correspondingly turning the pin with the threaded aperture of the frame 22.

Still another alternative embodiment of attaching the net 24 to the frame 22 is the provision of fabric strands attached to a hook which has a bolt externally threaded portion that engages a correspondingly internally threaded portion in the frame 22 and a thumb screw fixedly attached to the bolt that is on the opposite side of the frame 22 where the aforementioned internally threaded aperture begins nearest the fabric strands. In this additional alternative embodiment, tension can be selectively increased or decreased in the net 24 by simply turning the thumb screw attachment.

Figure 8:
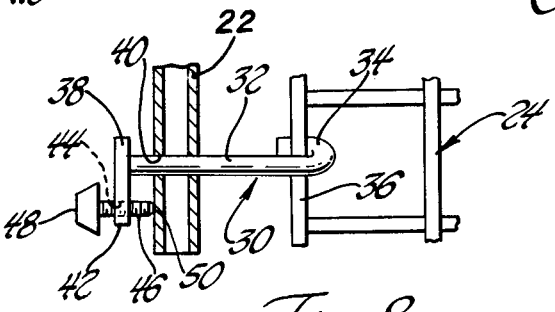
FIG. 8 is a view of a portion of the apparatus shown in FIG. 3 with a tensioning apparatus.

A further additional embodiment of the tensioning means is shown in FIG. 8, where the tensioning means is referred to generally by numeral 30, comprising a square bolt member 32 with a hook end portion 34 that engages a strand 36 of the net 24. A bolt head portion 38 is provided on the side of the bolt member 32 opposite from the side of the net. A square aperture 40 having dimensions corresponding to the exterior dimensions of the bolt portion 32 is provided within the tubular structure of the frame 22. On an extended portion 42 of the bolt head portion 38 an aperture 44 is provided. This aperture 44 is cylindrical in shape and has internal threads. Corresponding external threads are provided on a shank portion 46 of a cylindrical bolt member 48. The end 50 of the threaded shank portion 46 engages the exterior surface of the tubular structure of the frame structure 22.

It can be appreciated from the immediately foregoing description of the further alternative embodiments of the tensioning device 30 that tension can be selectively increased or decreased on the net 24 by selectively increasing the distance between the bolt head 38 and the tubular frame structure 22 by appropriately rotating the threaded bolt 48.

Figure 9:
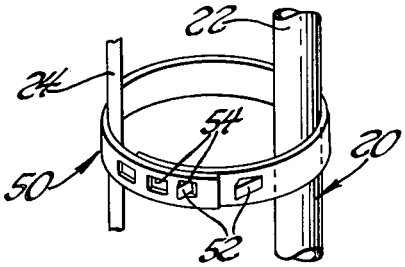
FIG. 9 is an alternative form of tensioning apparatus used in FIG 3.

Still another embodiment of the tension providing means is shown in FIG. 9 showing a portion of the tubular frame 22, part of the net 24, and a flexible rubber or plastic belt member 50 that wraps around the tube 22 and portions of the net webbing 24 and has a plurality of uniformly spaced ridges 52 that will engage a buckling member 54 on the opposite end of the belt member 50.

Figure 4:
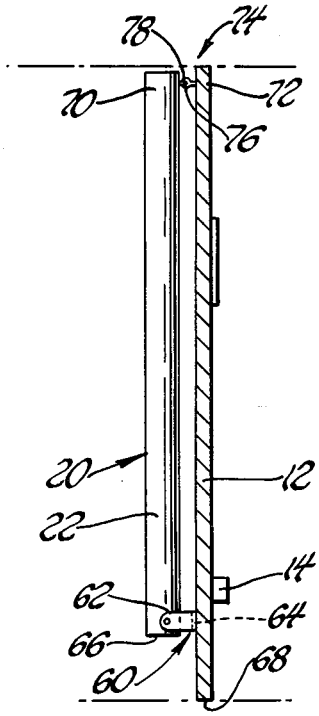
FIG. 4 is a transverse sectional view of the apparatus shown in FIG. 1 taken along the sectional lines 4—4 thereof.
Figure 5:
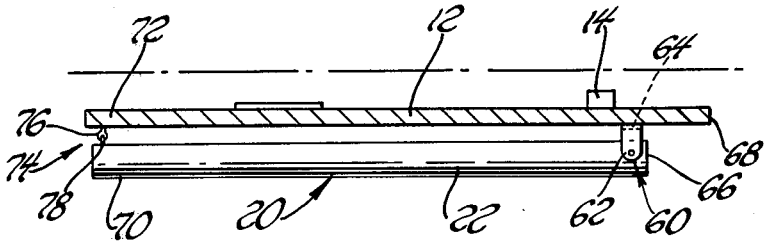
FIG. 5 is a transverse sectional view of the apparatus shown in FIG. 2 taken along the sectional lines 5—5 thereof.
Figure 6:
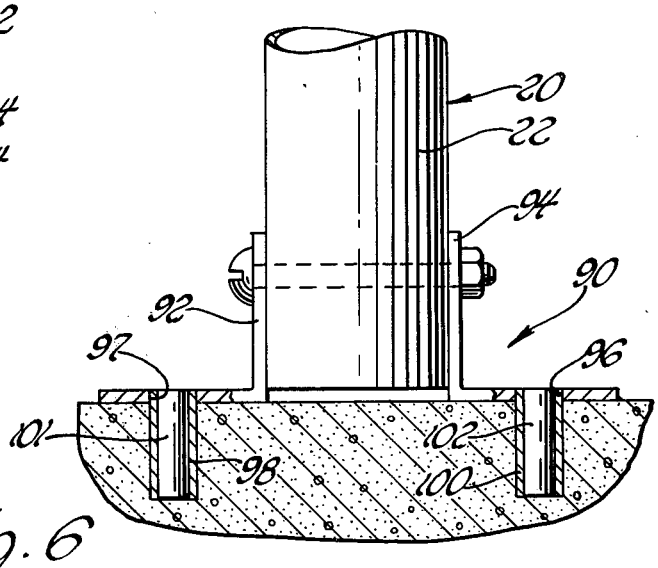
FIG. 6 is a transverse sectional view of the apparatus shown in FIG. 3.

When the garage door is in the closed position shown in FIG. 1, and shown in partial transverse sectional view in FIG. 4, the practice net 20 is located within a plane substantially parallel to the plane of the garage door 12 and is secured to the bottom of the garage door by means of a hinge member 60. The hinge member 60 has one flange portion 62 that is rigidly attached to the net frame 22. The hinge member 60 also has a corresponding hinge bracket member 64 that is fixed to the bottom of the garage door 12. It can be appreciated that when the garage door is in the closed position as shown in FIGS. 1 and 4 the top portion 66 of the practice net 20 is proximate the hinge member 60 and also proximate the bottom portion 68 of the garage door 12.

The bottom portion 70 of the practice net is proximate the top portion 72 of the garage door 12. The bottom portion 70 of the net frame 22 is secured to the top portion 72 of the garage door 12 by means of a latching mechanism 74.

In the preferred embodiment of this invention, the latching mechanism 74 comprises an eye portion 76 which is fixed to the top portion 72 of the garage door 12 and a hook portion 78 which is attached to the bottom portion 70 of the practice net 20. When the garage door is in the lower position shown in FIG. 1 or the raised position shown in FIG. 2 the net 20 is secured to the garage door 12 by the engagement of the hook member 78 with the eye member 76.

An alternative means of selectively attaching the bottom portion 70 of the net 20 to the top portion 72 of the garage door 12 may be by means of magnets that attract one another and are attached respectively to the garage door and to the net or by other appropriate selectively latching and de-latching means.

In the preferred embodiment of this invention, the bottom of the practice net 20 is free to move with the momentum of an impending tennis ball. Because of the difference in masses, this movement is small, but it provides different rebound positions of the ball, and adds to the realism of practice and its consequent enrichment.

Means 90 may be provided for securing the bottom of the practice net 20 to an area of the ground surface immediately below the bottom of the garage door 12 to maintain the practice net 20 in a substantially vertical planar configuration. These means 90 comprise brackets 92, 94 fixedly attached to the practice net frame structure 22 fore and aft of such structure respectively. Apertures 96, 97 are provided within the brackets 92, 94.

Cylindrical sleeve structures 98, 100 are provided within the concrete or driveway surface area and are immediately below and have a central axis corresponding to the central axis of apertures 92, 94 respectively. Pins 101, 102 pass through the apertures 96, 97 respectively and into cylindrical sleeve structures 98, 100 respectively. The sleeve structures 98, 100 are preferably made of metal in order to retain their cylindrical shape and to resist deformation by force on the practice net 20 when the net is used in the practice of sporting activities.

Figure 7:
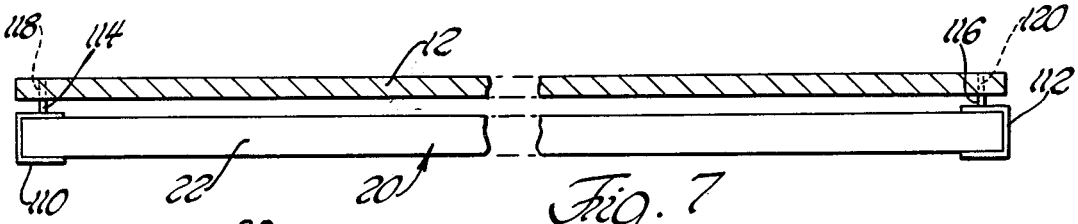
FIG. 7 is a partial cross-sectional view of an alternative embodiment of this invention.

An alternative embodiment of this invention is illustrated in FIG. 7. Channel members 110, 112 are provided on the left and right hand sides of the door 12 respectively. These channel members are preferably made of SAE 2020 aluminum alloy. The distance between the respective arms of the channels 110, 112 is slightly greater than the thickness or width of the tubular structure of the frame 22 of the practice net 20. The channel members 110, 112 extend along the height of the garage door 12. The distance between the channel members 110, 112 is slightly greater than the linear width of the practice net 20. As shown in FIG. 7, the practice net 20 is slid between the channel members and engages the flanges of the channel members 110, 112 when the practice net is in a stored condition. It can be appreciated that the net can remain within these channels by the insertion of pins 114, 116 in corresponding apertures 118, 120 near the bottom of the garage door and within the channel members 110, 112.

Figure 10:
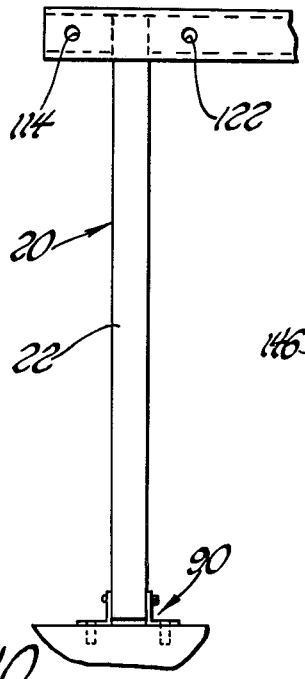
FIG. 10 is a side view of the apparatus as shown in FIG. 3 with an alternative means of securing the net structure.

When the practice net is in an open or operable position as shown in FIG. 10, it can be seen that additional apertures 122 are provided aft (as shown when the garage door is in an up position) or above (when the garage door is in a closed position). Looking at one side of the apparatus as shown in FIG. 10, aperture 122 is aft of aperture 114 and a pin is passed through aperture 122 behind the practice net 20. The distance between apertures 114 and 122 is slightly greater than the thickness of the frame structure 22 of the practice net, so that when the practice net is in the up and playing condition, the pins passing through apertures 114, 116 and apertures 122 limit the movement of the upper portion of the practice net 20. The bottom movement of the practice net 20 is limited by the same means 90 as shown in the preferred embodiment of this invention.

From the preceding description of the structure of the preferred and alternative embodiments of this invention, it can be appreciated that a practice net has been provided that can be readily stored within a confined space closely proximate and in a vertical plane substantially parallel with that of the garage door when the garage door is either raised or lowered. Further, the practice net can be readily placed in the playing condition by simply lowering the net into the appropriate position by first de-latching as shown in the preferred embodiment or by sliding out of a channel structure as shown in the alternative embodiment and then secured by means of pins into a retaining structure at the bottom of the practice net in both the preferred and alternative embodiments of this invention while the top is retained by means of a hinged connection to the garage door in the preferred embodiment of this invention and by means of additional poles passed through appropriately placed apertures and channel members in the alternative embodiment of this invention.

Figure 11:
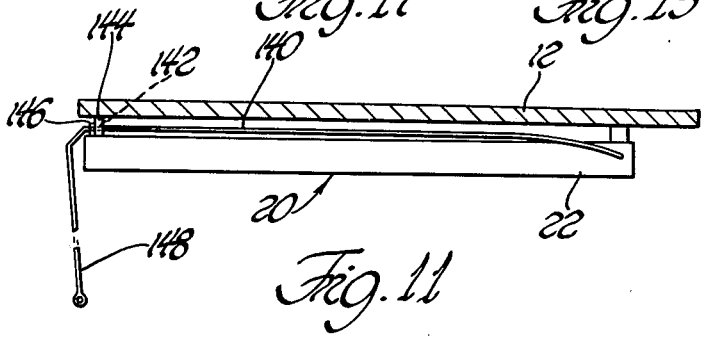
FIG. 11 shows an alternative method of moving and securing the garage door apparatus shown in FIG. 2.

In a further alternative embodiment of this invention shown in FIG. 11, the hook and eye arrangement shown in the preferred embodiment of this invention can be replaced by a cord attached to the top portion of the frame structure 22, this cord being referred to by numeral 140, and passing through an aperture 142 in a bracket 144 fixedly attached near the bottom of the garage door 12. A metal clip 146 selectively grips the cord 140 at a position below or forward of the bracket 144. A length of the cord 148 correspondingly approximately to the height of the garage door extends beyond the connection of this clip 146 to the cord 140. When the garage door is up as shown in FIG. 11 and it is desired to lower the practice net 20 into playing position, the clip 146 may be simply manually squeezed thereby releasing it from engagement with the cord 140 and the cord then will be forced upward by the gravity pull on the top of the practice net 20 and the practice net 20 will then be lowered by gravity into the appropriate playing position.

This additional alternative embodiment as shown in FIG. 11 is designed to allow the lowering of the practice net from fixed attachment of the top thereof to the garage door 12 by a person without requiring that person to stand within or proximate to the downward travel path of the practice net 20.

Figure 12:
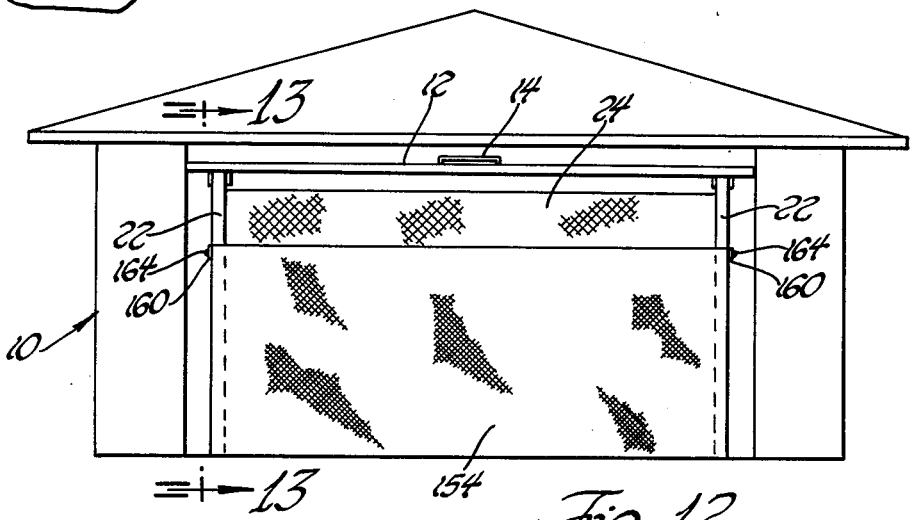
FIG. 12 is an alternative embodiment of this invention showing the addition of a golf practice net to the apparatus shown in FIG. 3.
Figure 13:
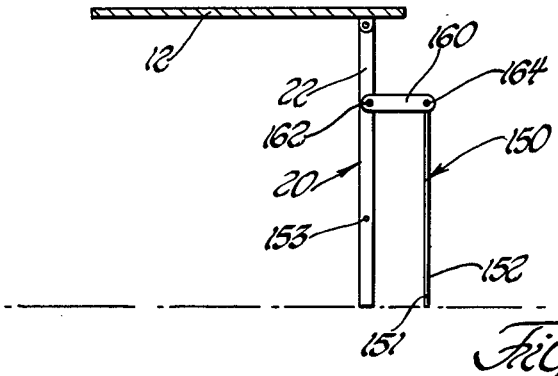
FIG. 13 is a side view of the apparatus shown in FIG. 12.

A further alternative embodiment of this invention is shown in FIGS. 12 and 13. A golf practice net having a relatively finer mesh is shown generally at 150 with numeral 154 indicating the mesh of the net. Rod-like structures 152 are provided as a frame for the golf net. A linkage, preferably a rigid member preferably made of metal, is shown at numeral 160. This link member 160 is pivotally connected by means of a rigid or other appropriate pivotal connection means to the frame of the tennis net as shown at 162 and by similar means is pivotally connected to the frame 152 as shown at 164. It can be appreciated that because of the pivotal connections 162, 164, by means of the linkage 160 the golf practice net 150 can be folded upwards and lie in a substantially flat plane below and forward of the structure 20 for rotation into a storing position such as that shown in FIGS. 1 and 2. Further, it can be appreciated that should a golf shot miss the structure 150 the structure 20 will prevent the ball from going into the garage when the structure is down as shown in FIGS. 12 and 13.

Figure 14:
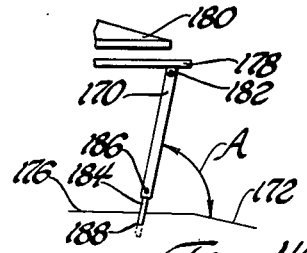
FIGS. 14 and 15 are diagrams of alternate embodiments.
Figure 15:
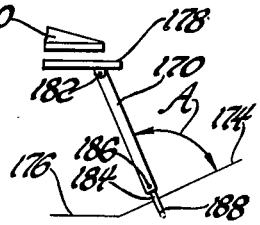

FIGS. 14 and 15 are partial cut-away side diagrammatic views of alternative embodiments of this invention depicting angular displacement and extension or reduction of links of the frame 170 for conditions where the driveway 172, 174 slopes respectively downward from or upward from the relatively flat horizontal plane 176 of the floor of the garage. As can be observed in these views the garage door 178 is in a raised position beneath the roof 180 of the garage, and the frame 170 is hinged at a point 182 near what would be the bottom of the door when the door is in a closed position. Extension members 184 are fixed by means of a pin or nut and bolt fastener 186 near the bottom portion of the frame 170 holding the net (not shown in the side view) and extend into a depression 188 in either the floor of the garage (FIG. 14, downward slope of driveway) or in the driveway (FIG. 15, upward slope from garage floor) and the extension member 184 is sliding within a tube-like outlet of frame 186 in such a manner as to extend the length of the frame member and extension member 184 in FIG. 14 (downward slope of driveway) or reduce the overall length of the combination of the horizontal frame member 170 and extension member 184, FIG. 15 (upwardly extending slope of garage floor) from what would be a medium such length should the driveway be in a substantially flat condition or substantially coplanar with the floor of the garage. In both FIGS. 14 and 15, as well as the situation where the driveway is coplanar with the floor of the garage, the angle A, that is the angle between the plane of the net and held by the frame 170, and the plane in which the driveway approaching the garage rests (172, 174 respectively) remains at substantially 90°. This is done in order to achieve the same effect, that is a mirror effect, of a ball bouncing off the net and back onto the court (here the driveway) so that a player practicing tennis off this practice net will have the same effect as if the ball was hit back by an opponent on the other side of the net. More precisely, by holding to this orthogonal relationship between the driveway and the net, the mirror-like effect achieved by conservation of momentum of the tennis ball bouncing off the net is preserved for varying conditions of a sloping driveway with respect to the plane of the floor of the garage.

In the apparatus shown in FIGS. 12 and 13, when the forward net is raised, it may be secured to the aft net structures by passing a threaded bolt through apertures 151 and 153, respectively, in the forward and aft net structures 150 and 20, respectively, and secured with a wing nut.

We claim:

1. In combination with a building overhead door having an interior side and an exterior side and being capable of occupying a lowered closed position whereby said door has a lower edge disposed proximate to the ground and a raised open position whereby said lower edge is disposed away from the ground, a practice net for impacting by a ball and for rebounding said ball, said practice net comprising a substantially rectangular frame, a net, means for holding said net stretched within the periphery of said frame, hinge means pivotally attaching an end of said frame proximate to said lower edge of said overhead door and latching means removably fastening the other end of said frame to the interior side of said overhead door above said lower edge of said overhead door for maintaining said frame in a stored position in a plane substantially parallel to the interior side of said overhead door, said frame being suspended from said lower edge of said overhead door when said door is raised and said practice net is in use with said latching means unfastened.

2. The practice net of claim 1 wherein said means for holding said net within the periphery of said frame are adjustable means providing adjustable tension on said net.

3. The practice net of claim 1 further comprising means removably attaching said frame to the ground.

4. The practice net of claim 1 wherein said frame is made of tubular metallic members.

5. The practice net of claim 1 wherein said frame further comprises a pair of telescopic adjustable legs each mounted on a side of said frame for engagement with the ground and for supporting said frame from the ground at an angle relative to the vertical.

6. The practice net of claim 1 further comprising a second net and link means supporting said second net spaced from and substantially parallel to said first mentioned net, said link means comprising a pair of rigid members each pivotally attached at an end to one side of said frame and pivotally attached at the other end to a side of said second net.

* * * * *

UNITED STATES PATENT AND TRADEMARK OFFICE

CERTIFICATE OF CORRECTION

PATENT NO. : 4,183,524

DATED : January 15, 1980

INVENTOR(S) : Warren M. Kifferstein et al

It is certified that error appears in the above-identified patent and that said Letters Patent are hereby corrected as shown below:

Col. 1, line 14, change "The devises" to --These devices--.

Col. 2, line 16, before "attaching" insert --means--.

Col. 3, line 25, after "net" insert --or webbing--.

Signed and Sealed this

*Twenty-ninth* Day of *April 1980*

[SEAL]

*Attest:*

SIDNEY A. DIAMOND

*Attesting Officer*

*Commissioner of Patents and Trademarks*